United States Patent [19]

Ishida et al.

[11] Patent Number: 4,473,947

[45] Date of Patent: Oct. 2, 1984

[54] SCISSORS

[76] Inventors: Kimikazu Ishida, 73, 1270 Shukuhara; Tsuneo Ishida, 15, 3-7 Hukui, both of Miki-shi, Hyogo-ken, Japan

[21] Appl. No.: 386,425

[22] Filed: Jun. 8, 1982

[30] Foreign Application Priority Data

Sep. 18, 1981 [JP] Japan ..... 56-139469

[51] Int. Cl.[3] ..... B26B 13/28

[52] U.S. Cl. ..... 30/267; 30/261

[58] Field of Search ..... 30/267, 261, 270, 266; 308/DIG. 7

[56] References Cited

U.S. PATENT DOCUMENTS 3,289,296 12/1966 Hedstrom ..... 30/267

3,355,200 11/1967 Storch ..... 30/267 X 3,672,053 6/1972 Wiss ..... 30/267

*Primary Examiner*—Jimmy C. Peters

*Attorney, Agent, or Firm*—Koda and Androlia

[57] ABSTRACT

The pair of scissors including a receiving blade and a cutting blade which are rotatably coupled by means of a center bolt whose end is anchored to one of the two blade bodies. Before inserting and anchoring the center bolt, a bushing made of engineering plastic having a flange is fitted to the base portion of the center bolt and inserted into a shank hole formed in another one of the two blade bodies. The shape of the fitting portion between the center bolt and the bushing includes a tapered dish-like shape formed along the undersurface of the head portion of the center bolt and a tapered shape formed over the upper surface of the bushing which matches the undersurface of the center bolt.

1 Claim, 3 Drawing Figures

SCISSORS

BACKGROUND OF THE INVENTION

1. Field of the Invention

The present invention relates to scissors and more particularly to scissors used for gardening, cloth cutting, etc. and designed to rotatably engage a backing blade with a cutting blade by means of a center bolt.

2. Prior Art

In prior art scissors, one of the two blades that comes into contact with the nut is fastened by a fit insertion or screwing to the end of the center bolt in such a manner that the blade does not slide or rotate relative to the center bolt in order to prevent the loosing of the ceter bolt during use. The other one of the two blades that is located on the base side of the center bolt slidingly contacts the center bolt so that the tightness between the center bolt and the blade does not easily loosen.

In the construction above, the dimensions of the shank holes of the blades constituting the scissors and the center bolt that is inserted into the shank hole and rotatably join the blades are arranged to be such that the diameter of the center bolt is slightly smaller than the diameter of the shank hole to facilitate the insertion of the center bolt into the shank hole and with this fitting tolerance the center bolt can be easily inserted into the shank hole. However, because of this fitting tolerance, the scissors are bound from the beginning to have a backlash in the direction of the diameter of the center bolt to thereby give an unpleasant feeling to the user. Also, since the blade coming into contact with the head portion of the center bolt is in constant friction with the center bolt by sliding against it during the long period of use, a gap develops as a result of wear in this sliding contact portion with the result that backlash is caused in the axial direction of the center bolt. Consequently, there is an accompanying disadvantage in that unless the scissors are lubricated all the time, the frictional resistance gets higher thereby quickening the wear and rust forms to thereby hinder smooth operation.

SUMMARY OF THE INVENTION

Accordingly, it is the general object of the present invention to obviate the disadvantage of the prior art by avoiding contact between the sliding rotating blade and the center bolt. This is accomplished by inserting a bushing made of engineering plastics, such as polyamide resin, fluororesin, acetal resin (especially, acetal copolymer resin), over the center bolt.

BRIEF DESCRIPTION OF THE DRAWINGS

The above-mentioned features and objects of the present invention will become more apparent with reference to the following description taken in conjunction with the accompanying drawings, wherein like reference numerals denote like elements and in which.

DETAILED DESCRIPTION OF THE INVENTION

Figure 1:
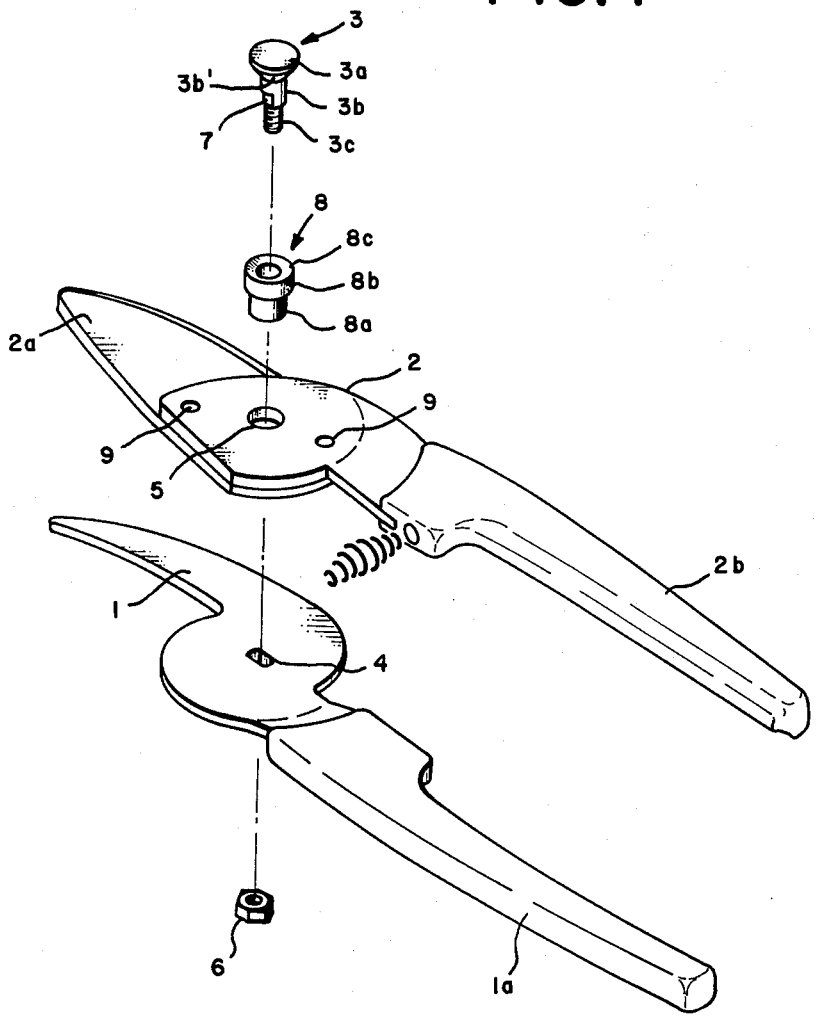
FIG. 1 is an exploded perspective view of the scissors in accordance with the teachings of the present invention.
Figure 2:
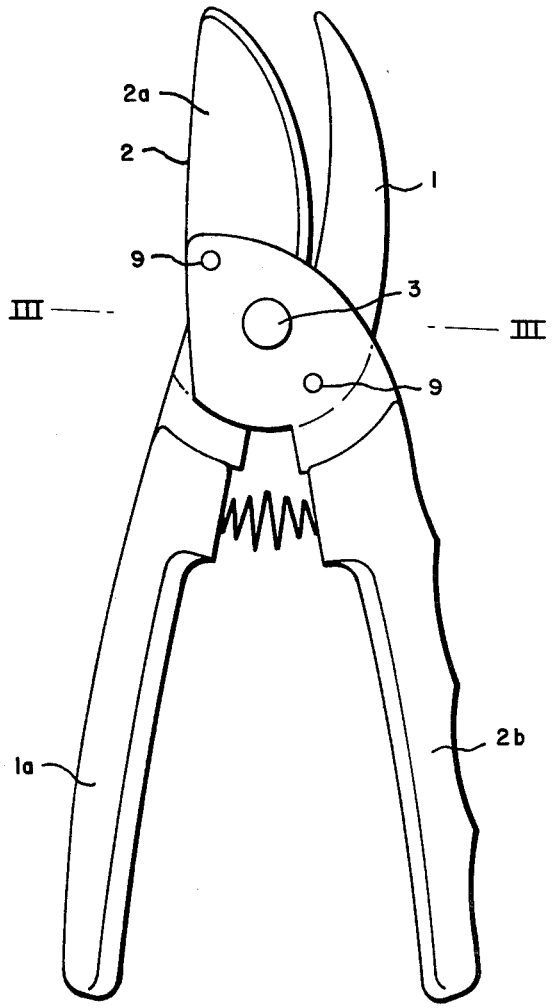
FIG. 2 is a front view of the scissors in accordance with the teachings of the present invention.
Figure 3:
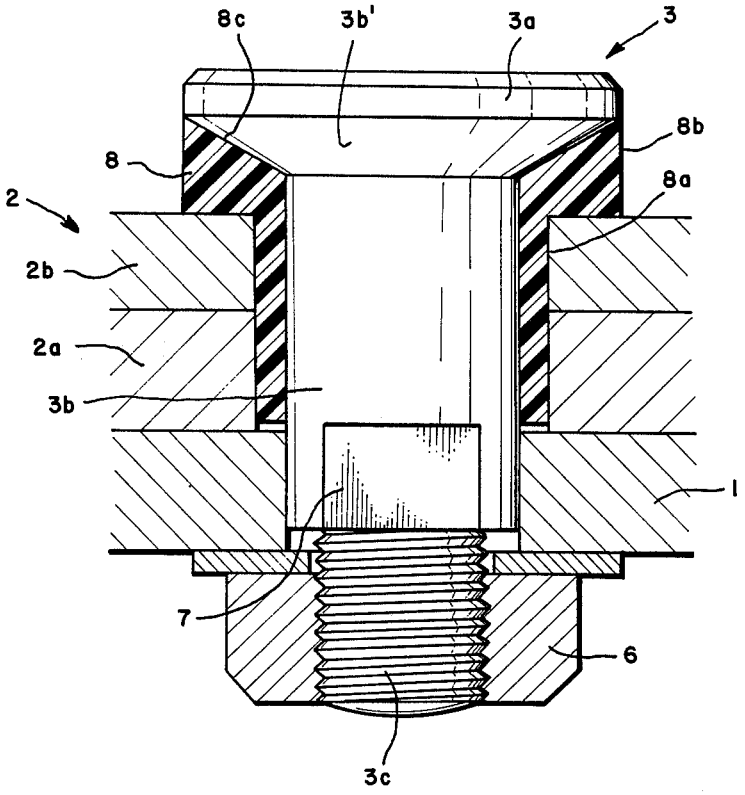
FIG. 3 is an enlarged sectional view along the line III—III in FIG. 2.

Referring more particularly to the drawings, shown therein is a scissors in accordance with the teachings of the present invention. As shown in FIGS. 1 and 2, the scissors includes a pair of blades, i.e. a receiving blade 1 and a cutting blade 2, that are pivotally joined by a center bolt 3. In the embodiment illustrated, the receiving blade 1 is combined with a handle grip 1*a* into a single body while the cutting blade 2 includes two parts, i.e. an edge portions 2*a* and a grip handle 2*b*, which are joined together into a single body by fastening screws 9.

Receiving blade 1 and the cutting blade 2 are perforated, respectively, to form shank holes 4 and 5. Center bolt 3 is inserted through the shank holes and then fastened with a nut 6. The center bolt consists of a head portion 3*a*, a cylindrical shaft 3*b* with a large diameter and an end portion 3*c* of the cylindrical portion 3*b* that is provided with fine threads. The length of the shaft portion 3*b* is made to be the same as or slightly shorter than the thickness obtained by overlapping the receiving blade 1 with the cutting blade 2. With this arrangement, when the center bolt 3 is inserted, only the threaded portion 3*c* sticks out of the receiving blade 1 and the center bolt 3 can be screwed tightly with the nut 6.

On the shaft portion 3*b* of the center bolt 3, the portion that comes into contact with the receiving plate 1 is provided with beveling 7; while the shank hole 4 of the receiving blade 1 is processed so as to match the sectional shape of the beveled shaft portion and both portions are fitted together so that the loose rotation can be prevented. The sectional shape of the fitting portion is not necessarily a perfect circle, it can be oval, etc. Other than the above, the design may be that the portion of the center bolt shaft 3 that comes into contact with the receiving blade 1 is threaded, while the shank hole 4 of the receiving blade is formed into a tapped hole and the threaded portion of the center bolt 3 is screwed into the tapped shank hole 4 so that the center bolt 3 and the receiving blade 1 do not floatingly rotate. Before the insertion of the center bolt 3, a physically as well as chemically stable bushing 8 that is made of engineering plastics with a low frictional resistance such as polyamide resin, fluororesin, acetal resin (especially, acetal copolymer resin), etc. is inserted and fitted into the shank hole 5 of the cutting blade 2. That is, the center bolt 3 is inserted through the bushing 8 having a flange portion 8*b* and a cylindrical collar 8*a* that is slightly shorter than the thickness of the cutting blade 2 and provided with an inside diameter sufficient in size to allow the cylindrical portion 3*b* of the center bolt 3 to be freely inserted. The diameter of the shank hole 5 of the cutting blade 2 is designed to be high in precision with a zero or slightly minus fitting tolerance in relation to the outside diameter of a collar 8*a* of the bushing 8.

Furthermore, the underside 3*b'* of the head portion of the center bolt 3 is recessed by being tapered into a dish-like shape while the upper surface 8*c* of the bushing 8 is formed with a tapered slope to match the shape of the under surface 3*b'* of the head portion of the center bolt 3 described above. In this manner, the center bolt 3 is guided into the center of the bushing 8 without fail when the center bolt 3 fastens the blades 1 and 2 together tightly. In this manner, the wear of bushing 8 caused by improper contact with the center bolt 3 is markedly reduced. Also, the backlash along the direction of the center bolt diameter that has accompanied conventional scissors due to the large fitting tolerance which existed from the time of production between the center bolt and the shank hole of the blade in the portion coming into contact with a center bolt is eliminated.

In the embodiment described above, the cutting blade 2 is composed of two separate units, i.e. the blade 2*a* and the handle grip 2*b;* however, just as the receiving blade 1 is made as a single unit, the cutting blade 2 could also be made into a single unit. Also, although the center bolt 3 is inserted from the cutting blade side to the receiving blade side and then screwed into the nut 6 from the receiving blade 1 side, the center bolt 3 could be inserted reversely from the receiving blade 1 side. In this case, the cutting blade 2 and the center bolt 3 would be engaged such that they do not rotate. In other words, the relationship is altered to be that, in the figures, the cutting blade 2 becomes the receiving blade while the receiving blade 1 becomes the cutting blade. Furthermore, as to the engagement between the receiving blade 1 and the center bolt 3, if the shank hole 4 of the receiving blade 1 is provided with thread taps, then the threaded portion of the center bolt 3 can be screwed into the tap portion and tightened and the cutting blade and the receiving blade can be held together rotatably.

According to the present invention, when the center bolt 3 is clamped with the nut 6, the center bolt 3 and the blade 2 do not directly contact each other so that metals do not rub each other and instead, the engineering plastics with small frictional coefficient comes in contact with the metal whereby smooth sliding and rotation of the cutting blade 2 with a light force and free of resistance occur. Therefore, unlike conventional scissors, the scissors of the present invention have the additional advantage that they do not need to be lubricated and do not get rusty in the movable portion. As a result, the durability as well as the wear resistance is increased. Furthermore, since the engineering plastic bushing 8 serves as a sort of buffering material, the mechanical strength is also improved.

With regard to the engineering plastics used for the present invention, it may be of some concern that the insertion of a plastic into such an important portion may reduce the durability in actual use; however, the engineering plastics such as polyamide resin, fluororesin, acetal resin has satisfactory physical, chemical and mechanical requirements and therefore, there is no need to worry about the application in the present invention and they can be used reliably.

Also, as has been described with reference to the above embodiment, if the center bolt 3 is made to be a dish-form bolt, the bushing 8 is provided with a recession tapered into the dish-like form that matches to the contour of the center bolt 3 when the center bolt 3 is clamped. Therefore, the bolt 3 can always be positioned at the center of the bushing 8 thereby contributing to the elimination of the backlash caused by the offsetting of the receiving blade 1 and the cutting blade 2 and smooth cutting is provided all the time. Furthermore, in conventional scissors when center bolt is clamped tightly, an unpleasant feeling is sensed by user due to the jarring of the blade during movement; however, in the present invention such a drawback is avoided.

It should be apparent to those skilled in the art that the above-described embodiment is but one of the many specific embodiments which incorporates the principles of the present invention. Numerous and varied other arrangements can be readily devised by those skilled in the art without departing from the spirit and scope of the invention.

I claim:

1. A pair of scissors comprising:

a receiving blade and a cutting blade;

a center bolt to rotatably couple said receiving blade to said cutting blade, the end of the center bolt being non-rotatably coupled to one of the blades by means of a nut and washer, an undersurface of a head portion of said center bolt being tapered into a dish-like form; and a bushing made of engineering plastic having a flange that is fitted to the base portion of the center bolt with said head portion of said center bolt engaging an upper surface of said flange and is inserted into a shank hole provided in another one of the blades, said tapered dish-like undersurface of said head portion fitting into a tapered slope provided in said flange.

* * * * *